US005435570A

United States Patent [19]

Labrasseur

[11] Patent Number: 5,435,570

[45] Date of Patent: Jul. 25, 1995

[54] GAME APPARATUS WITH LAUNCHING DEVICE AND METHOD OF PLAYING

[76] Inventor: Robert Labrasseur, 244 W. 56th St., New York, N.Y. 10019

[21] Appl. No.: 353,808

[22] Filed: Dec. 12, 1994

[51] Int. Cl.[6] ..... A63F 9/00

[52] U.S. Cl. ..... 273/355; 273/428

[58] Field of Search ..... 273/348, 350, 353, 355, 273/356, 357, 399, 428

[56] References Cited

U.S. PATENT DOCUMENTS

| | | | |
|---|---|---|---|
| 680,175 | 8/1901 | Reinhart | 273/355 |
| 732,281 | 6/1903 | Durboraw | 273/355 |
| 817,928 | 4/1906 | Medley | 273/399 X |
| 1,542,012 | 6/1925 | Spilman | 273/348 |
| 1,542,063 | 6/1925 | Knight | 273/399 |
| 1,576,515 | 3/1926 | Kinney | 273/399 |
| 2,799,502 | 7/1957 | Isakson | 273/428 X |
| 3,528,385 | 9/1970 | Kohner | 116/121 |
| 3,565,432 | 2/1971 | Reiner | 273/95 |
| 3,669,451 | 6/1972 | Welbourn | 273/95 R |
| 3,715,121 | 2/1973 | Renn et al. | 273/428 X |
| 4,303,247 | 12/1981 | Fain | 273/324 |
| 5,288,071 | 2/1994 | Solomon | 273/85 C |

*Primary Examiner*—William H. Grieb
*Attorney, Agent, or Firm*—David L. Baker; Rhodes & Ascolillo

[57] ABSTRACT

A game apparatus has a target housing and a target chamber in the target housing. The chamber may be filled with water. A reference target, in the target chamber, has a reference base attached to the floor of the target housing. The reference base has a height "Hr". A first circuitous, closed-end, loop-shaped landing site (Lily Pad) is attached an end of the reference base distal another end of the reference base attached to the floor. A plurality of first and second associated targets in the target chamber. The first associated targets have a first associated base attached to the floor. The first associated bases have a height "Ha" that is less than "Hr". The second associated bases have second associated base attached to the floor. These second associated bases have a height "Ha" greater than "Hr". There is a second circuitous, closed-end, loop-shaped landing site (Lily Pad) attached to the first associated bases and a third circuitous, closed-end, loop-shaped landing site (Lily Pad) attached to the second associated bases. There is a first score indicator on the first landing site, a second score indicator on the second landing site and a third score indicator on the third landing site. A projectile is removably placed on a launching member and springingly projected therefrom toward the first, second and third landing sites. The projectile is shaped like an animal such as an amphibian and more particularly as a frog.

10 Claims, 2 Drawing Sheets

GAME APPARATUS WITH LAUNCHING DEVICE AND METHOD OF PLAYING

BACKGROUND OF THE INVENTION

1. Field of the Invention

This invention relates to a game of skill in launching a frog-like projectile, from a catapult, onto a numbered lily pad to achieve the highest score.

2. Description of the Related Art

There have been many games developed to entertain children and adults. Several of these involved propelling a projectile at a target. However, some of these involved goals that were either too complicated to interest children or involved so little skill as to cause adults to lose interest.

U.S. Pat. No. 3,528,385 to Frank Kohner on Sep. 15, 1970 for a Game with Catapult Launcher describes a game wherein the players select a projectile of a certain color and use the launcher to attempt to project the projectile into a color matched receptacle. There is a score keeping dial on the launcher.

U.S. Pat. No. 3,565,432 L. L. Reiner on Feb. 23, 1971 for Methods and Apparatus for a Chance Controlled Catapult Game shows a game wherein players are randomly selected to slap a lever that launches a bee toy to try to place it in a certain area of a target. The opponents try to strike the bee from its path with a hand-held racket.

U.S. Pat. No. 3,669,451 to D. K. Welbourn on Jun. 13, 1972 for a Catapult Game Including Striking Wallet and Receiver describes a game wherein the player launches the projectile and then tries to catch the projectile in mid air using an appropriate receptacle.

U.S. Pat. No. 4,303,247 to D. A. Fain on Dec. 01, 1981 for a Catapult Game shows a game wherein the player has a resilient catching and throwing device to catch a ball and return it to an opponent. Skill is required in determining the amount of "snap" to use to propel the ball and in directing the ball in a chosen direction.

U.S. Pat. No. 5,288,071 to A. C. Solomon on Feb. 22, 1994 for a Game Apparatus describes a game wherein the players launch a light weight ball from a catapult and the players then use a pivoted air jet to try to direct a ball toward or away from a hoop as in basketball.

The present game solves these problems by providing a game that is simple enough for children to play yet requires skill to operate for innovative adults.

SUMMARY OF THE INVENTION

In one aspect of the present invention, a game apparatus combination is described that has a target housing and a target chamber in the target housing. There is a plurality of pedestal targets in the target chamber. Each of the targets has a columnar base attached to a floor of the target housing. A circuitous, closed-end, loop-shaped landing site is attached to the base. There is a score indicator on the landing site. A launching member is disposed near the target housing. There is a projectile launch plate on the launching member and a projectile removably placed on the projectile launch plate and springingly projected therefrom toward the landing sites.

In a second aspect of the present invention, a game apparatus combination is described that has a target housing and a target chamber in the target housing. There is a reference target in the target chamber. There is a reference base, attached to a floor of the target housing, that has a height "Hr". A first circuitous, closed-end, loop-shaped landing site is attached to the reference base. There is at least one associated target in the target chamber.

The associated target has an associated base, attached to the floor, having a height "Ha" less than "Hr". A second circuitous, closed-end, loop-shaped landing site is attached to the associated base. There is a first score indicator on the first landing site and a second score indicator on the second landing site. At least one launching member is disposed near the target housing. There is a projectile launch plate on the launching member. A projectile is removably placed on the projectile launch plate and springingly projected therefrom toward the first and second landing sites.

A method of playing a game apparatus combination involves placing a game housing on a playing surface and filling a chamber in the housing with water. A next step is placing lily pad targets in the chamber. Then one places numeric scores on the targets. The players then arrange launching members around the housing and then proceed by placing a frog-like projectile on the launching member. The players continue the game by propelling the frog-like projectile toward and onto the targets and tallying a score based on the number of frog-like projectiles landing on the targets. Then the players determine a winner of the game. The method of playing the game may be changed by using targets of varying heights or by adjusting the height of the targets from a floor of the housing.

It is an object of this invention to provide a game wherein one or more players may use a launching device to propel a frog-like projectile onto a target that looks like lily pad and accumulate a certain score.

DESCRIPTION OF THE PREFERRED EMBODIMENT

Figure 1:
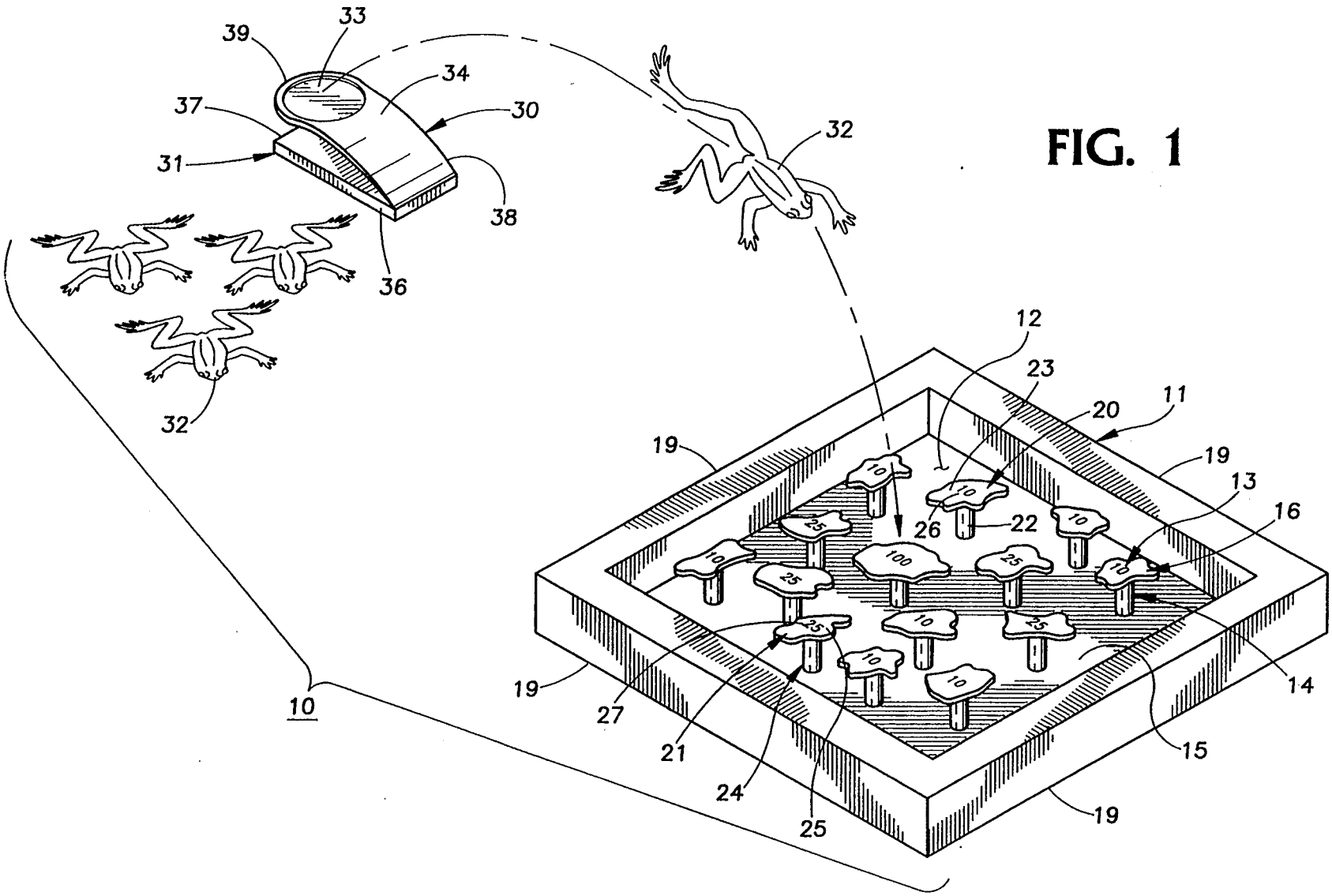
FIG. 1 is a perspective view of the Game Apparatus with Launching Device showing a frog projectile being launched toward a landing site of the target member from one of the launching members.
Figure 2:
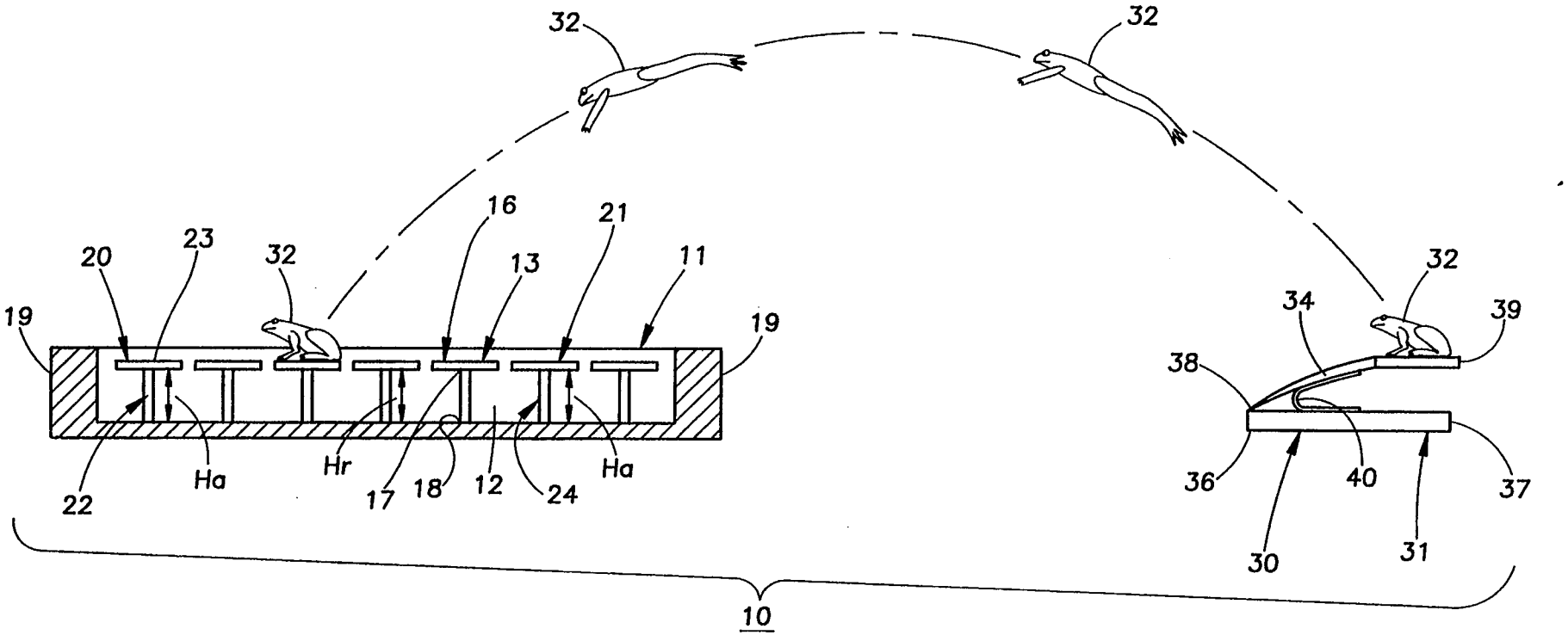
FIG. 2 is a left side elevational view with a cross-sectional view of the target member and showing a frog projectile in stages of being propelled toward a landing site (Lily Pad).

Referring to FIGS. 1 and 2, a game apparatus combination 10 is shown and described that has a target housing 11 and a target chamber 12 in the target housing 11. There is a reference target 13 in the target chamber 12 (Any target could be selected as the reference target.). The reference target 13 has a reference base 14 attached to the floor 15 of the target housing 11. The reference base 14 has a height "Hr"; and a first circuitous, closed-end, loop-shaped landing site 16 attached an end 17 of the reference base distal another end 18 of the reference base attached to the floor 15. The target housing 11 could be made of any suitable plastic or it could be made out of wood or cardboard. The walls 19 of the housing 11 could be as high or higher than the targets. The target bases might be made adjustable to vary the skill factors and variety of the game. Adjustment could be by mating threaded tubes (not shown) or a tube tightly sliding over another tube or post (not shown).

There is a plurality of first associated targets 20 and second associated targets 21 in the target chamber 12. The first associated targets 20 have a first associated base 22 attached to the floor. The first associated bases 22 have a height "Ha" that is less than "Hr". The second associated targets 21 have a second associated base 24 attached to the floor. These second associated bases 24 have a height "Ha" greater than "Hr". There is a second circuitous, closed-end, loop-shaped landing site 23 attached to the first associated bases 22 and a third circuitous, closed-end, loop-shaped landing site 25 attached to the second associated bases 24. There is a first score indicator 26 on the first landing site 16, a second score indicator 27 on the second landing site 23 and a third score indicator 27 on the third landing site 25. The targets could be made of the same materials as the target housing. The housing could be illustrated to resemble a pond and the targets to resemble lily pads. The numeric scores on the surface of the landing sites (lily pads) vary and enhance the playing of the game.

At least one launching member 30 is disposed near the target housing 11. There is a projectile launch plate 33 on the launching member 30. A projectile 32 is removably placed on the projectile launch plate 33 and springingly projected therefrom toward the first 16, second 23 and third 25 landing sites. The projectile 32 is shaped like an animal such as an amphibian and more particularly as a frog 32. The launching members 30 could be made of metal, plastic or wood and in the case of metal or plastic, the launch base 31 and launch arm 35 could be manufactured in one piece. Wood would likely require the two pieces to be hinged together as in a standard two-arm hinge and pin. The projectile launch plate 33 is preferably placed on the top surface 34 of the launch arm 35 to provide a steady place to place the frog 32 prior to launching. The projectile launch plate 33 could be a shallow cup or a plate having a non-skid surface to reduce projectile slippage prior to and during launch.

The launching member 30 has a launch base 31 and a launch arm 35. The launch base 30 has a hinge end 36 and a launch end 37. A first end 38 of the launch arm 34 is hingedly connected to the hinge end 36 of the launch base 31. The launch arm 34 has a second end 39 distal the first end 38. A projectile launch plate 33 is attached at or near the second end 39 of the launch arm 34. There is a launch spring 40 (preferably made of spring steel), connected to the launch base 31 and to the launch arm 34, springingly and radially biasing the second end 39 of the launch arm 34 away from launch end 37 of the launch base 31.

In operation, the players may use one or more launching members 30 which can be placed at agreed upon distances from the target housing 11. The longer distances could provide a multiplying factor to the numeric scores on the lily pads 13, 20 and 21. The frogs 32 are provided in different colors, Each player may have one to several frogs to launch but preferably five. The frogs could be made from any soft material but rubber or a similar resilient material is preferred. The surface of the frogs could have a slightly non-skid or tacky surface to reduce sliding off of the surface of the target lily pad. Each Lily Pad may have a different numeric score on it. Highest score out of five launches wins. If one player's frog lands on another players frog, the top frog gets the same score as the bottom frog. Displaced frogs lose their score because they are not on a lily pad at the time the score is tallied. For more reality, the target chamber 12 could be partially filled with water. The game 10 not only enhances hand and eye coordination, it assists children in learning math by score keeping.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. A game apparatus combination comprising:
(a) a target housing;
(b) a target chamber in the target housing;
(c) a plurality of pedestal targets in the target chamber;
(d) each of the targets comprising:
a columnar base attached to a floor of the target housing; and
a circuitous, closed-end, loop-shaped landing site attached to the base;
(e) a score indicator on the landing site;
(f) a launching member disposed near the target housing;
(g) a projectile launch plate on the launching member; and
(h) a projectile removably placed on the projectile launch plate and springingly projected therefrom toward the landing sites.

2. A game apparatus combination comprising:
(a) a target housing;
(b) a target chamber in the target housing;
(c) a floor in the target housing;
(d) a reference target, in the target chamber, comprising;
a reference base, attached to the floor, comprising a height "Hr"; and
a first circuitous, closed-end, loop-shaped landing site attached to the reference base;
(e) at least one associated target, in the target chamber, comprising:
an associated base, attached to the floor, having a height "Ha" less than "Hr"; and
a second circuitous, closed-end, loop-shaped landing site attached to the associated base;
(i) a first score indicator on the first landing site;
(g) a second score indicator on the second landing site;
(h) at least one launching member disposed near the target housing;
(i) a projectile launch plate on the launching member; and
(j) a projectile removably placed on the projectile launch plate and springingly projected therefrom toward the first and second landing sites.

3. A game apparatus combination comprising:
(a) a target housing;
(b) a target chamber in the target housing;
(c) a floor in the target housing;
(d) a reference target, in the target chamber, the reference target comprising:
a reference base, attached to the floor, comprising a height "Hr"; and
a first circuitous, closed-end, loop-shaped landing site attached to the reference base;
(e) a plurality of first associated targets, in the target chamber, the first associated targets comprising:
a first associated base, attached to the floor, having a height "Ha" less than "Hr"; and a second circuitous, closed-end, loop-shaped landing site attached to the first associated base;

(f) a plurality of second associated targets, in the target chamber, the second associated targets comprising:

a second associated base, attached to the floor, having a height "Ha" greater than "Hr"; and a third circuitous, closed-end, loop-shaped landing site attached to the second associated base;

(f) a first score indicator on the first landing site;

(g) a second score indicator on the second landing site;

(h) a third score indicator on the third landing site;

(i) at least one launching member disposed near the target housing;

(j) a projectile launch plate on the launching member; and (k) a projectile removably placed on the projectile launch plate and springingly projected therefrom toward the first, second and third landing sites.

4. A game apparatus combination as described in claim 3 wherein the projectile further comprises being shaped like an animal.

5. A game apparatus combination as described in claim 4 wherein the animal further comprises being shaped like an amphibian.

6. A game apparatus combination as described in claim 5 wherein the amphibian further comprises being shaped like an frog.

7. A game apparatus combination as described in claim 3 wherein the launching member further comprises:

(a) a launch base;

(b) a hinge end of the launch base;

(c) a launch end of the launch base;

(d) a launch arm;

(e) a first end of the launch arm hingedly connected to the hinge end of the launch base;

(f) a second end of the launch arm distal the first end;

(g) the projectile launch plate attached to the second end of the launch arm; and (h) a launch spring, connected to the launch base and to the launch arm, springingly and radially biasing the second end of the launch arm away from launch end of the launch base.

8. A method of playing a game apparatus combination comprising:

(a) placing a game housing on a playing surface;

(b) filling a chamber in the housing with water;

(c) placing lily pad targets in the chamber;

(d) placing numeric scores on the targets;

(e) arranging launching members around the housing;

(f) placing a frog-like projectile on the launching member;

(g) propelling the frog-like projectile toward and onto the targets;

(h) tallying a score based on the number of frog-like projectiles landing on the targets; and (i) determining a winner of the game.

9. A method as described in claim 8 further comprising using targets of varying heights from a floor of the housing.

10. A method as described in claim 8 further comprising adjusting the height of the targets from a floor of the housing.

* * * * *